United States Patent [19]

Larson

[11] Patent Number: 4,536,623

[45] Date of Patent: Aug. 20, 1985

[54] ELECTRO-ACOUSTIC TRANSDUCER WITH DIAPHRAGM AND BLANK THEREFOR

[76] Inventor: David A. Larson, 2460 Wisconsin Ave., Downers Grove, Ill. 60515

[21] Appl. No.: 503,947

[22] Filed: Oct. 13, 1983

Related U.S. Application Data

[62] Division of Ser. No. 389,423, Jun. 16, 1983.

[51] Int. Cl.[3] ..... H04R 9/00; H04R 7/14

[52] U.S. Cl. ..... 179/115 R; 179/115 V; 179/115.5 R; 179/115.5 ES; 179/115.5 PV

[58] Field of Search ..... 179/115.5 PV, 115.5 ES, 179/115.5 R, 115 R, 115 V, 117, 119 R, 181 R, 184, 180; 181/167, 172, 173, 174

[56] References Cited

U.S. PATENT DOCUMENTS

| | | | |
|---|---|---|---|
| 3,164,686 | 1/1965 | Tibbetts | 179/115.5 R |
| 3,171,904 | 3/1965 | Poutot | 179/115.5 R |
| 3,829,623 | 8/1974 | Willis et al. | 179/115.5 PV |
| 3,922,504 | 11/1975 | Kishikawa | 179/115.5 PV |
| 3,939,312 | 2/1976 | McKay | 179/115.5 PV |
| 3,997,739 | 12/1976 | Kishikawa et al. | 179/115.5 PV |
| 4,228,327 | 10/1980 | Sawafuji | 179/115.5 PV |
| 4,276,449 | 6/1981 | Sawatuji | 179/115.5 PV |

*Primary Examiner*—Gene Z. Rubinson
*Assistant Examiner*—Danita R. Byrd
*Attorney, Agent, or Firm*—Bernard L. Kleinke

[57] ABSTRACT

The transducer diaphragm includes a folded sheet of thin film material, having a front surface and having a plurality of rearwardly extending projections in the form of fins or vanes thereon. Each one of the projections has at least one conductor portion disposed thereon. A substantially flat, thin sheet is secured to form the front face of the diaphragm and to help rigidify the folded sheet. In the preferred form of the invention, each one of the projections is generally channel-shaped throughout its length, and has a bight portion interconnecting a pair of leg portions. In one form of the invention, at least one portion of a conductor is disposed on each one of the projections. The diaphragm is made from a blank, which includes the sheet of film material having a pair of similar conductors, each configured in a similar manner and deposited on the opposite sides thereof in an oppositely disposed confronting relationship and in registration with one another, so that the blank can be readily folded to form the diaphragm, without causing it to bow or otherwise be deformed.

10 Claims, 9 Drawing Figures

FIG. 1
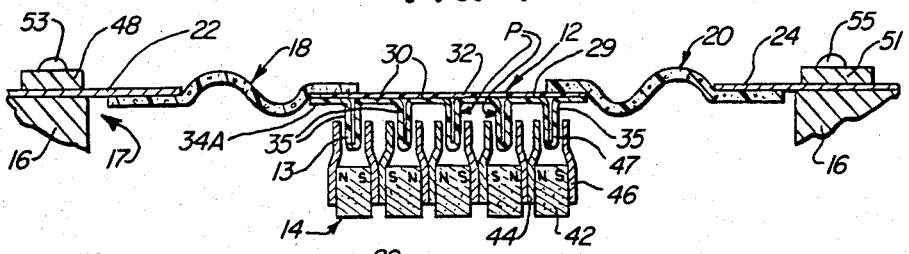
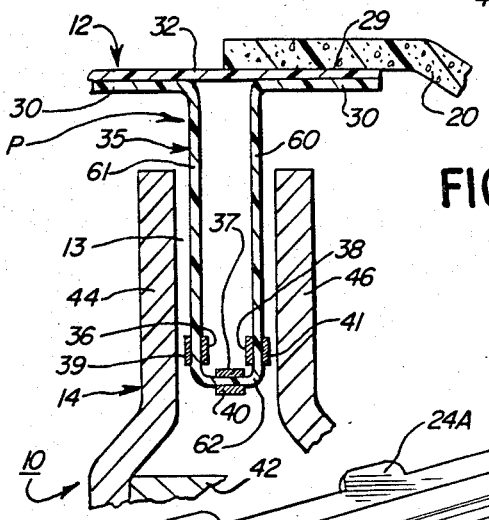
FIG. 2
FIG. 3
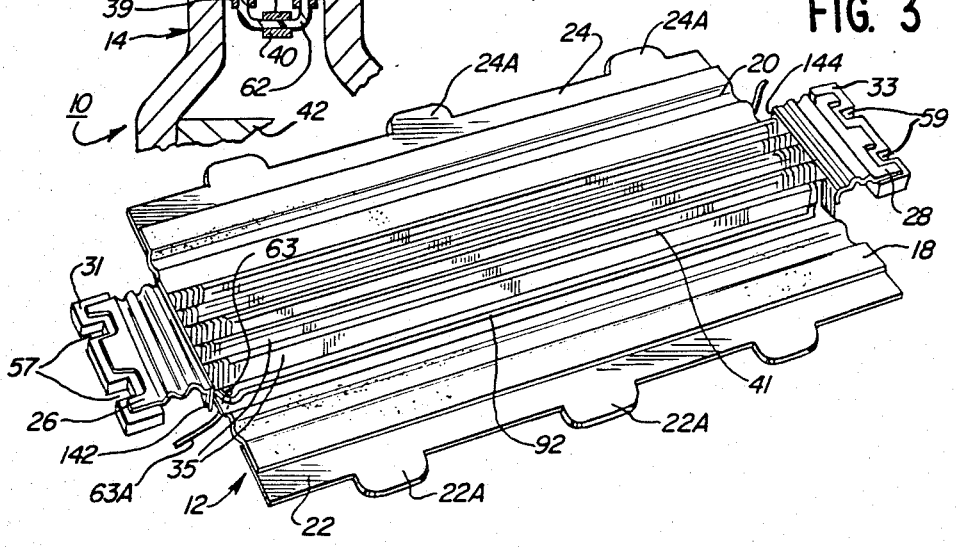
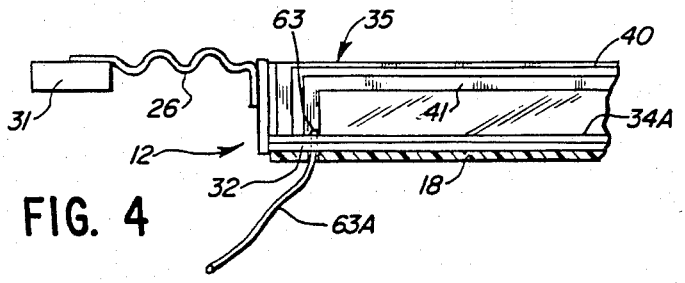
FIG. 4

FIG. 5
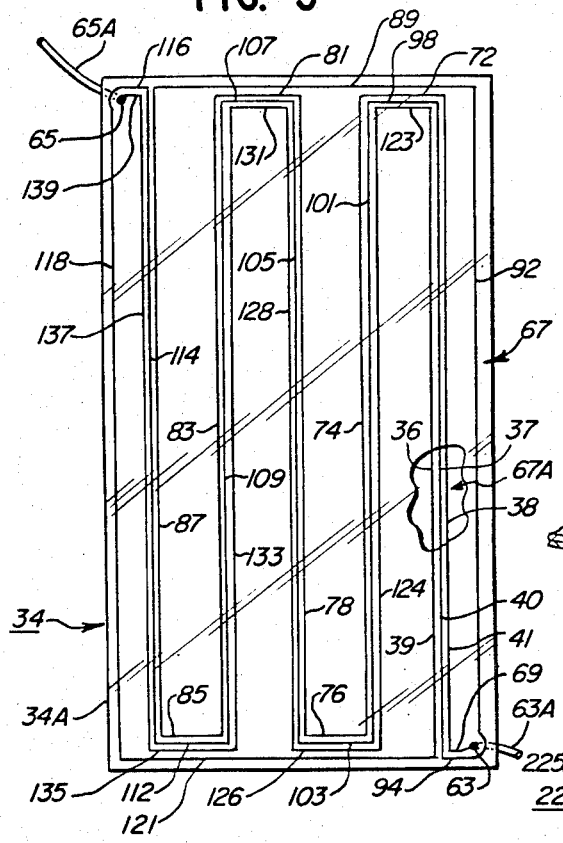
FIG. 7
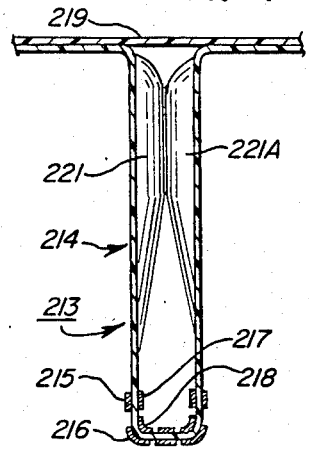
FIG. 8
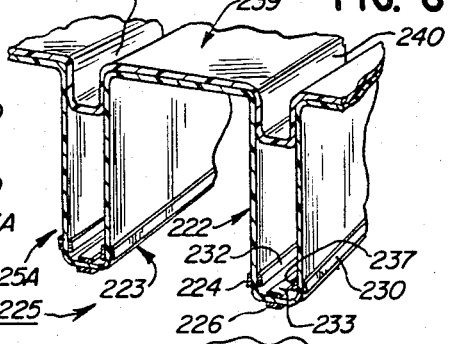
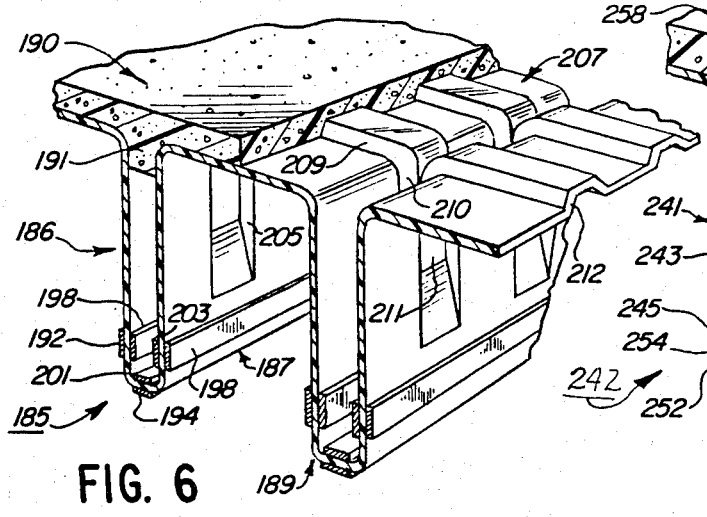
FIG. 6
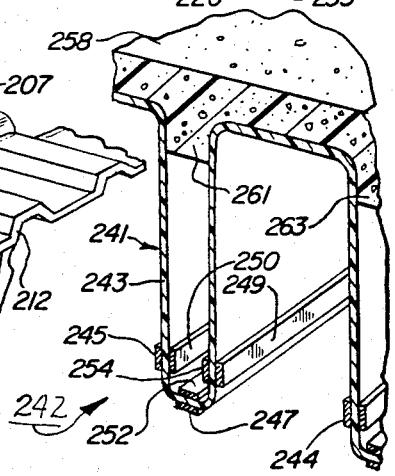
FIG. 9

ELECTRO-ACOUSTIC TRANSDUCER WITH DIAPHRAGM AND BLANK THEREFOR

This is a division of application Ser. No. 389,423, filed June 16, 1983.

DESCRIPTION

1. Technical Field

The present invention relates in general to an electro-acoustic transducer with a diaphragm and a blank therefor, and it more particularly relates to such a transducer with a substantially planar diaphragm and a blank therefor, for greatly increased performance.

2. Background Art

There have been different types and kinds of electro-acoustic transducers. Such a transducer may be a loudspeaker or a microphone. Each one includes a movable diaphragm, which interacts with the surrounding atmosphere to either produce sound waves, or to be set into motion by sound waves. As will become apparent to those skilled in the art, the present invention relates to both types of electro-acoustic transducers. However, for the sake of clarity, ohly loudspeakers will be shown and described herein.

Conventional conically-shaped loudspeakers, by the very shape of the cone, produces distortion of the sound emitted thereby. Such distortion is known as the "cavity effect". Sound propagating from the speaker cone is not emitted uniformly from the surface thereof, because sound waves emitted from the central portion of the cone are out of phase with the sound waves emitted from the peripheral portions thereof. The latter sound waves travel a shorter distance from the diaphragm to the listener, as compared to the waves emitted from the central portion of the cone.

There have been a variety of loudspeaker constructions, some of which have been designed in such a manner so as to attempt to overcome this problem. For example, reference may be made to the following United States Patents: U.S. Pat. Nos. 3,164,686; 3,171,904; 3,922,504; 3,939,312; 3,997,739; 4,056,697 and 4,276,449.

The U.S. Pat. No. 3,171,904, discloses a loudspeaker having a diaphragm constructed for the purpose of attempting to eliminate distortions by providing a speaker diaphragm, which has a generally planar or flat face, so that the entire surface moves in an oscillatory manner by substantially the same distance during use. An attempt was made to have substantially all sound waves emanating therefrom in phase with one another, thereby reducing distortion.

The loudspeaker diaphragm construction, shown and described in U.S. Pat. No. 3,171,904, is constructed of expanded polystyrene to render it relatively light in weight. However, such a material is not sufficiently rigid, and therefore the high frequency response is not at all satisfactory for many applications.

The expanded polystyrene diaphragm has electrical voice coils imbedded therein for coacting with a magnetic field. The diaphragm is in the form of a solid block of polystyrene material, having grooves or slots therein to define a series of projections, each having a voice coil conductor at the tip thereof. The conductor coacts with the magnet assembly to drive the diaphragm. However, in order to reduce the weight of the diaphragm to an acceptable low level and to allow suitable attachment, there is a single voice coil conductor on each projection, and a single conductor does not provide adequate resistance properties, as well as efficiency, for some applications. Also, it is difficult, if not impossible, to add additional conductors with such a construction, since there is very little space for such additional conductors. Also, such a construction is very expensive to manufacture.

In order to obtain good high frequency response, it would be necessary for the speaker diaphragm shown in U.S. Pat. No. 3,171,904, to have a much greater number of conductors for a given area to provide adequate electromagnetic energy, and to attain the desired impedance. In this regard, the current industry standard is a resistance of between four and eight ohms, to accomodate standard amplifiers.

Alternatively, the patented diaphragm could be connected in series with a large number of similar sized units to develope a sufficient electrical resistance to produce the desired impedance. However, such an arrangement would be highly unsatisfactory for many applications, since there would have to be an unacceptably large number of such speaker diaphragms connected in series. The only other alternative would be to connect a resistor electrically in series with the voice coil to provide the proper resistance. However, such an approach is usually not satisfactory, because the resistor merely dissipates the electrical signal without using it, and thus the speaker is not very efficient in operation. Also, by connecting the resistor in series, if one unit fails, the entire unit would malfunction. Such an arrangement is highly unsatisfactory for many applications, because the additional speaker diaphragms connected in series would add greatly to the bulk, size and weight of the speaker system, and certainly would be prohibitively expensive for most applications.

Probably, the most serious drawback to the use of expanded polystyrene, is the inherent spongy, nonrigid property of the material. Such material does not lend itself to the conduction of high frequencies.

The U.S. Pat. No. 4,276,449, discloses a transducer diaphragm constructed of a sheet of thin film material folded into an elongate arcuate corrugated shape. Current carrying conductors are positioned on both sides of the film, and are positioned at the troughs of the folded film diaphragm, to extend between spaced apart permanent magnet rods.

However, the series of elongate peak portions of the diaphragm present an uneven front surface. Thus, they fail to achieve the desired effect of having substantially all of the sound waves, emanating therefrom, to be in phase with one another for the purpose of greatly reducing, or eliminating distortion.

Also, the elongate peaks and troughs are not secured together, or otherwise supported, except at the side edges of the folded film, thereby resulting in a flimsy structure. Thus, the troughs and the conductors thereon are not securely positioned in alignment with the magnetic structure. As a result, during the rapid movement of the diaphragm relative to the magnet rods, sideward movement of the troughs is possible, and hence, the desired precise magnetic interaction between the current carrying conductors on the diaphragm troughs and the magnet rods, can not be achieved, for some applications.

Additionally, the conductors are positioned on both sides of the film out of phase with one another, so that when the thin film is folded, it tends to buckle or bow, and thus not achieve the desired proper alignment with the gaps between the magnet rods.

Therefore, it would be highly desirable to have an electro-acoustic transducer having a diaphragm which, when used as a speaker, greatly reduces, if not minimizes, speaker distortion, and yet is highly efficient in operation. In this regard, it should be sufficiently light in weight, and yet have the capability of including an adequate number of voice coil conductors, to obtain satisfactory impedance characteristics.

Such a diaphragm should be substantially rigid, to maintain proper alignment of its conductors with its magnetic structure during use. Also, such a speaker diaphragm should be relatively less expensive to manufacture.

DISCLOSURE OF INVENTION

Therefore, the principle object of the present invention is to provide a new and improved electro-acoustic transducer with a diaphragm and a blank therefor, which greatly reduces transducer distortion, and provides accurate reproduction with efficient operation.

Another object of the present invention is to provide such a new and improved electro-acoustic transducer with a diaphragm and a blank therefor, wherein the diaphragm is relatively light in weight and yet includes a large number of conductors, and which is relatively inexpensive to manufacture and is structurally strong.

Briefly, the above and further objects of the present invention are realized by providing an electro-acoustic transducer with a movable diaphragm and a blank therefor, which is generally flat in configuration.

The transducer diaphragm includes a folded sheet of thin material, having a front surface and having a plurality of rearwardly extending projections in the form of fins of vanes thereon. Each one of the projections has at least one conductor portion disposed thereon. A substantially flat, thin sheet is secured to form the front face of the diaphragm and to help rigidify the folded sheet. In the preferred form of the invention, each one of the projections is generally channel-shaped throughout its length, and has a bight portion interconnecting a pair of leg portions.

In one form of the invention, at least one portion of a conductor is disposed on each one of the projections. The diaphragm is made from a blank, which includes the sheet of film material having a pair of similar conductors, each configured in a similar manner and deposited on opposite sides thereof in an oppositely disposed confronting relationship and in registration with one another, so that the blank unfolded is stable and does not tend to roll up or distort in form due to the stresses posed by conductor application, and can be readily folded to form the diaphragm, without causing it to bow or otherwise be deformed.

By employing the lightweight film material, many more conductors can be readily deposited thereon to provide for high efficiency in the use thereof, as compared to prior known diaphragms. Thus, a highly desirable response is achieved, since the novel diaphragm is composed of lightweight materials and yet has a large number of conductor portions thereon. In this regard, a plurality of conductor portions are preferably disposed on both the inside and the outside of each projection to enable the diaphragm material to remain flat in an unfolded state, and have a large number of passes of the conductor portions relative to a magnet assembly, when the transducer is an electro-dynamic loudspeaker, during the use thereof.

The lightweight flat diaphragm of the present invention functions as a heat pump by forcing air around the conductors, so as to cool the unit during use. Heat build-up is one of the main reasons for the malfunctioning of conventional loudspeakers, since heat causes the voice coil conductors to de-laminate from the bobbin which is attached to the cone of the diaphragm. In this regard, the adhesive oftentimes melts, as a result of the increased temperature, especially when the loudspeaker is driven excessively due primarily to lack of adequate air circulation. Whereas, in the inventive loudspeaker, air is moved past the conductor and is vented through gaps in the magnet assembly, for cooling purposes, so that as the diaphragm oscillates, air is drawn into and out of the space around the conductors for cooling purposes. The harder the diaphragm is driven, the more the diaphragm's motion removes heat from the unit.

Also, the diaphragm coacts electromagnetically with permanent magnet structures, which are distributed uniformly over the rear face of the diaphragm to provide for a uniform response. The loudspeaker employing the inventive diaphragm, is a full range loudspeaker.

When the inventive diaphragm is used in a loudspeaker, the lightweight construction, with a large number of current carrying conductors, provides a superior response at high frequencies. Also, the channel-shaped configuration of the projections, together with the sheet secured to it, render the resulting diaphragm suitably structurally strong mechanically, to help maintain the series of spaced-apart conductor-carrying projections in accurate alignment with the permanent magnet pole piece gaps of the magnet assembly.

BRIEF DESCRIPTION OF DRAWINGS

The above-mentioned and other objects and features of this invention and the manner of attaining them will become apparent, and the invention itself will be best understood by reference to the following description of embodiments of the invention taken in conjunction with the accompanying drawings, wherein;

FIG. 1 is a fragmentary sectional view of an electro-acoustic transducer in the form of a loudspeaker, which is constructed in accordance with the present invention;

FIG. 2 is a greatly enlarged, fragmentary detail sectional view of one portion of the diaphragm of the loudspeaker of FIG. 1, illustrating it in position in a gap of the driver magnet assembly;

FIG. 3 is a pictorial view of the loudspeaker diaphragm of FIG. 1, illustrating the underside thereof;

FIG. 4 is a fragmentary sectional enlarged elevational view of the end portion of the diaphragm of FIG. 3;

FIG. 5 is a partly schematic face view of a film blank of the diaphragm of FIG. 3, prior to its final folding, illustrating the blank with a portion thereof broken away to show the conductors being shown schematically as lines for illustration purposes;

FIG. 6 is a fragmentary, sectional pictorial view of a portion of another electro-acoustic diaphragm, which is also constructed in accordance with the present invention, which incorporates corrugations in the top thereof contiguous to the pinched projections thereof;

FIG. 7 is a fragmentary, sectional elevational view of a portion of another electro-acoustic diaphragm, which is also constructed in accordance with the present invention;

FIG. 8 is a fragmentary, sectional pictorial view of a further electro-acoustic diaphragm, which is also constructed in accordance with the present invention; and FIG. 9 is a fragmentary, sectional pictorial view of a further electro-acoustic diaphragm, which is also constructed in accordance with the present invention.

BEST MODE FOR CARRYING OUT THE INVENTION

Referring now to the drawings, and more particularly to FIGS. 1, 2, and 3 thereof, there is shown an electro-acoustic transducer in the form of an electrodynamic loudspeaker 10, which is constructed in accordance with the present invention.

The loudspeaker 10 generally comprises a rectangular diaphragm or membrane 12, which coacts electromagnetically with a series of pole piece gaps 13 of a magnet assembly 14 (FIG. 1). A housing or baffle frame 16 supports the diaphragm 12 movably across an opening 17 therein, in front of the magnet assembly 14. In this regard, a pair of flexible surround (suspension) strips 18 and 20 extend transversely longitudinally from, and are connected to, the opposite side marginal edges of the diaphragm 12 and a pair of elongated gasket strips 22 and 24 are connected at their side marginal edges to the respective surround strips 18 and 20 for connection to the frame 16. Each one of the gasket strips 22 and 24 includes a series of integral spaced-apart finger tabs **22*a* and 24*a*, respectively, to facilitate the positioning of the gasket strips, and therefore the diaphragm and projections P, relative to the magnet assembly gaps 13 mounted behind an opening 17 within the driver frame 16, during the assembly of the loudspeaker. As shown in FIG. 3, a pair of flexible spider connector strips 26 and 28 extend transversely from the end marginal edges of the diaphragm 12 and interconnect them to the respective ones of a pair of generally rectangular end mounting blocks 31 and 33, which, in turn, are adapted to be attached to the frame 16 at the opening 17** therein.

As best seen in FIG. 1, a front surface 29 of a folded sheet 34A is formed by a series of substantially flat portions 30 interconnecting integrally a series of parallel spaced-apart rearwardly extending conductor carrying projections P and being arranged generally in a common plane. The conductor carrying projections P interact magnetically with the permanent magnet assembly 14 to move the diaphragm 12 for producing the desired sound waves.

The interconnecting portions 30 are disposed transversely, substantially at 90°, to the longitudinal axis of the projections P. A backing sheet 32 is in the form of a thin film sheet, which overlies and is secured to the interconnecting portions 30 to help rigidify the projections and the overall structure of the diaphragm 12. Also, the front face of the sheet 32 provides a substantially smooth, flat surface for the diaphragm 12 to enable it to function with little distortion throughout the entire frequency range.

The sheet 32 is affixed to the interconnecting portions, which provide substantial surface areas of attachment so as to securely attach the sheet 32 to the sheet 34A and its projections P. In this manner, the sheet 32 remains substantially flat during use, to provide the desired frequency response characteristics.

As shown in FIG. 5, the diaphragm 12 (FIG. 1) generally comprises a blank 34 which includes the rectangular sheet 34A of the thin film material, and which, prior to its folding, is substantially flat in configuration. The assembly of the diaphragm 12 includes the folding of the blank 34 to form the series of longitudinally extending spaced-apart, parallel projections P in the form of vanes or fins 35, which are each elongated and channel-shaped and generally U-shaped in cross-section throughout their lengths. The vanes or fins 35 extend rearwardly toward the magnet assembly 14.

As shown in FIG. 2, a series of inner voice coil conductor portions, such as the conductor portions 36, 37 and 38, are deposited on one side of the film blank 34 and are disposed on the inside of the vanes, such as the vane 35. A series of outer voice coil conductor portions, such as the conductor portions 39, 40 and 41, are deposited on the opposite side of the film blank (FIG. 5) in registration with the corresponding respective conductor portions 36, 37 and 38, and are disposed on the outside of the vanes, such as the vane 35.

As shown in FIGS. 1 and 2, the magnet assembly 14 generally comprises a series of magnets, such as magnet 42, which are arranged in a side-by-side configuration, and which are permanent magnets each having its north and south poles oriented as indicated in the drawings. As shown in FIG. 1, adjacent portions of the magnets have like polarity. Each one of the driver magnets has a pair of elongate steel pole pieces disposed on the opposite sides thereof, such as the magnet pole pieces 44 and 46 disposed on the opposite sides of the permanent magnet 42, to form a series of parallel spaced-apart gaps 47 for receiving the vanes 35 of the diaphragm 12 therebetween.

During use, the diaphragm 12 oscillates and thus the vanes 35 move longitudinally within the pole pice gaps 47, as a result of the dynamic electromagnetic interaction between the current carrying conductor portions on the vanes and the permanent magnet pole pieces. The same oscillating movement of the vanes 35, and attached backing sheet 32 also causes air to be displaced from the gaps 47 for cooling purposes, thereby relieving heat build-up. The harder the diaphragm is driven, the greater the pumping action of the diaphragm occurs for withdrawing greater quantities of air for cooling purposes. Such a greater flow rate of air is desirable, since heat build-up increases as the diaphragm is driven harder, espcially where it is driven beyond desired limits and since in some applications (such as automotive) ambient temperatures are high.

Referring now to FIG. 1, in order to attach the surround strips 18 and 20 to the driver frame 16, a pair of gasket strip plates 48 and 51 clamp the respective gasket strips 22 and 24 to the frame 16, and screws 53 and 55 fasten the strip bars to the frame 16. As shown in FIG. 3, screw notches 57 and 59 in the respective mounting blocks 31 and 33 receive the mounting screws (not shown) for fastening the mounting blocks to the frame 16.

As best seen in FIG. 2, each one of the projections P has a pair of leg portions 60 and 61 interconnected at their rear ends by a bight portion 62. The leg portions are disposed transversely, substantially at right angles, to the bight portion 62. It should be noted that the inner and outer conductors 37 and 40 are disposed directly opposite to one another, on opposite sides of the bight portion 62. The conductors 38 and 41 are disposed on opposite sides of the leg portion 60, and the conductors 36 and 39 are positioned on opposite sides of the leg portion 61.

Considering now the film blank 34 in greater detail with reference to FIG. 5, the blank 34 is formed generally of any suitable high temperature group of thermoplastic blend material. The preferred material is polysulfone, such as the polysulfone sold under the trademark "UDEL" by Union Carbide of Danbury, Conn. Other suitable compositions include "ULTEM" by General Electric Company; "POLYETHER SULFONE" (polyphenyl sulfone), sold by Imperial Chemical Industries, and "RADEL" (polyphenyl sulfone) sold by Union Carbide. Also, suitable polycarbonates, such as "LEXAN" sold by General Electric Company, may be employed. Polyimides may also be employed.

In general, the high temperature thermoplastic material should have a relatively high glass transistion temperature point, as well as a relatively high heat deflection temperature. In this regard, the sheet 34A is annealed and formed to the desired shape. In order to maintain the desired shape, during high temperature operation and even in elevated ambient temperatures, which can occur when the loudspeaker is employed in a closed vehicle parked in the sun, the annealing temperature should be preferably in the range of about 300° F. and 375° F., and preferably about 330° F. When the polysulfone "UDEL" is employed. However, it is to be understood that the materials having lower annealing temperatures may also be employed satisfactorily, but the foregoing temperature range is preferred as well as higher temperatures for other materials. The sheet has a thickness of about 3 Mils., and the conductors are about 1 Mil. in thickness.

The sheet 34A includes a conductor pattern, generally indicated at 67, deposited on the front side of the sheet 34A, interconnects a pair of terminals 63 and 65 electrically. A like mirror-image conductor pattern, generally indicated at 67A, is deposited on the back side of the sheet 34A disposed oppositely to, and in registration with, the conductor pattern 34 on the front side thereof. In this manner, the sheet 34A has a greater tendency to lie flat and not be warped, thereby greatly facilitating the folding thereof into the desired shape, as well as facilitating the storage of the blanks. After folding it along the longitudinal conductors into the shape as shown in FIGS. 1 and 3, the folded sheet 34A assumes the desired shape, with little or no bowing from end to end. It has been found that if the two conductor patterns are not disposed in registration with one another, the folded sheet becomes bowed from end to end, or is otherwise warped.

The conductor patterns 34 and 34A are connected electrically together in parallel. In this regard, the terminals 63 and 65 of the pattern 34 and corresponding terminals (not shown) of the pattern 34A on the back side of the sheet 34A are connected electrically. As shown in FIG. 4, a terminal wire 63A is soldered to the terminal 63 and its corresponding terminal on the reverse side of the sheet 34A, since the solder and the distal end of the wire 63A or an eyelet (not shown) extend through a hole in the sheet 34A. Similarly, a terminal wire 65A is connected electrically to the terminal 65 and the corresponding terminal of the conductor pattern 67A.

The conductor pattern 67 is a replicated Greek pattern and includes a transversely extending portion 69 integrally connected electrically at one of its ends to the terminal 63, and at its other end to the longitudinally extending conductor 41, which, in turn is connected integrally to an outer transversely extending portion 72. A longitudinally extending portion 74 extends from the transversely extending portion 72 to a transversely extending portion 76. Thus, the portions 41, 72 and 74 comprise a U-shaped portion of the pattern.

Similarly, a longitudinally extending portion 78 extends between the transversely extending portion 76 and another transversely extending portion 81, to complete a U-shaped configuration, comprised of portions 74, 76 and 78. A longitudinally extending portion 83 extends between the transversely extending portion 81 and another transversely extending portion 85 to cause the portions 78, 81 and 83 to assume a U-shaped configuration.

A longitudinally extending portion 87 connects integrally the transversely extending portion 85 and a longer transversely extending portion 89, which connects integrally to a longitudinally extending portion 92 disposed near the marginal edge thereof. A transversely extending portion 94 interconnects the conductor portion 92 and the longitudinally extending intermediate conductor portion 40. The portions 83, 85 and 87 also assume a U-shaped configuration.

The conductor portion 40 interconnects the transversely extending portion 94 with another transversely extending portion 98. The portion 98 extends parallel to the portion 72, which in turn is disposed between the portion 98 and the transversely extending longer portion 89.

A longitudinally extending portion 101 extends between the transverse portion 98 and a transversely extending portion 103. The portion 101 extends parallel to the portion 74, and the portion 103 extends parallel to the portion 76. A longitudinally extending portion 105 connects the portion 103 and a transversely extending portion 107, which, in turn, is disposed parallel to the portion 81.

A longitudinally extending portion 109, is disposed parallel to the portion 83 and connects the portion 107 and a transversely extending portion 112. The portion 109 extends parallel to the portion 83 and the portion 112 extends parallel to the portion 85.

A longitudinally extending portion 114 extends parallel to the portion 87, and interconnects the portion 112 and a short transversely extending portion 116. A longitudinally extending portion 118 connects the portion 116 and a long transversely extending portion 121. The portion 118 is disposed near the left margin edge of the blank 34, and the portion 121 extends parallel to the bottom marginal edge thereof.

The conductor 39 is longitudinally extending, and is connected between the long transversely extending portion 121 and a short transversely extending portion 123. A longitudinally extending portion 124 extends parallel to the portion 101 and interconnects the portion 123 and a transversely extending portion 126. Similarly, a longitudinal portion 128 connects the portion 126 and another transversely extending portion 131.

A longitudinally extending portion 133 extends between the portion 131 and a transversely extending portion 135. A longitudinally extending portion 137 interconnects the portion 135 and a short connecting portion 139, which terminates at the terminal 65.

As shown in FIGS. 3 and 4, the blank 34 is folded longitudinally to form a series of pleats to form the projections P, as best seen in FIG. 3. In order to help rigidify the diaphragm 12, a pair of end strips or walls 142 and 144 are secured to the ends of the folded blank 34, by any suitable techniques, such as by heat sealing, of by the application of suitable adhesives or solvent. As shown in FIGS. 1 and 4, the backing sheet 32 is secured over the front surface 29 formed by the connecting portions 30 of the folded blank 34 to provide a smooth uninterrupted planar surface, and to add to the overall rigidity of the structure.

Referring now to FIG. 6, there is shown another acoustic transducer 185, which includes a diaphragm 186, constructed in accordance with the present invention and adapted to be driven by a magnet assembly (not shown) of a similar construction to the magnet assembly of FIG. 1.

The diaphragm 186 is generally similar to the diaphragm 12 of FIG. 1, and includes a series of spaced-apart, longitudinally extending projections in the form of vanes or fins, such as vanes 187 and 189, which are channel-shaped throughout their length and U-shaped in cross-section.

A backing sheet 190 is secured by any suitable technique, such as by applying a suitable adhesive or by sonically welding, and serves the same purpose as the backing sheet 32. A series of parallel spaced-apart depending ridges, such as the ridge 191, depends into the upper portions of the vanes, such as the vane 186, for helping to provide sideward stability thereof. The sheet 190 is composed of a suitable foam material, such as an expanded polystyrene or an expanded polysulfone. The foam sheet 190 is molded to conform closely to the outer configurations of the front portion of the folded film diaphragm 186.

Considering now the vane 187 in greater detail, the other vanes are each similar to it and will not be described in any greater detail. A series of three outer voice coil conductors 192, 194 and 196 are deposited on the outer surface of the vane 187 in a similar manner as the outer voice coil conductors are connected to the diaphragm 12. A series of inner voice coil conductors 198, 201 and 203 are deposited on the inner surface of the vane 187 opposite the corresponding respective outer conductors.

In order to help rigidify and maintain stability and positioning of the vane 187, a series of longitudinally spaced-apart gussets or corrugations, such as the gusset 205, are provided in the vane 187. In this regard, the gussets help maintain the longitudinal axis of the vane 187 in a substantially perpendicular orientation relative to the plane of its backing sheet 219. Thus, the sideward stability of the vane 187 is enhanced. An integral web portion 207 interconnects the vanes, and is provided with a series of parallel spaced-apart ridges or corrugations, such as the ridge or corrugation 209 interconnecting the gusset 205 with a gusset 210 in the side of the vane 189. A gusset 211 in the opposite side of the vane 189 is complementary shaped relative to the gusset 210 and is heat sealed thereto to provide a rigid structure for the vane 189. A ridge or corrugation 212 in the web portion 207 is continuous with the gusset 211. Thus, pairs of opposing complementary inwardly extending gussets (e.g., 210,211) are connected together by heat sealing or an adhesive to join opposing legs of the projections to stabilize sideward movement of projections.

Referring now to FIG. 7, there is shown an acoustic transducer 213, which is also constructed in accordance with the present invention, and which has a diaphragm 213A. The diaphragm 213A is generally similar to the diaphragm 186, of FIG. 6, except the manner in which the diaphragm 213A is rigidified.

The diaphragm 213A includes a series of parallel spaced-apart elongated projections in the form of fins or vanes, such as the vane 214, which is channel-shaped throughout its length, and is U-shaped in cross-section. A series of five spaced-apart outer conductors, such as the outer conductors 215 and 216, are arranged at the bottom portion of the vane 214. A series of five parallel spaced-apart inner conductors, such as the inner conductors 217 and 218, are disposed opposite to, and in registration with, the respective outer conductors 215 and 216.

A flat backing sheet 219 is secured to the remaining portion of the diaphragm in a similar manner as the backing sheet 32 is secured in place at the front portion of the diaphragm 12. A series of pairs of gussets, such as the gussets 221 and 221A are heat sealed together and are spaced apart along the vane 214 in a similar manner as the gussets of the diaphragm 186 of FIG. 6, except that the gussets do not extend to the upper web portion as in the case of the web portion 207 of the diaphragm 186.

Referring now to FIG. 8, there is shown an acoustic transducer 225, which is constructed in accordance with the present invention and which includes a diaphragm 225A driven by a magnet assembly (not shown) similar to the magnet assembly 14 of FIG. 1. The diaphragm 225A is generally similar to the diaphragm 186, with the exception of the backing sheet therefor. The diaphragm 225A includes a series of parallel spaced-apart U-shaped vanes, such as the vanes 222 and 223. Considering now the vane 222 in greater detail, it being understood that the vane 223 being generally similar to it. A series of three outer current carrying conductors 224, 226 and 230 are deposited on the outer surface of the bottom portion of the vane 222 in a similar manner as the outer conductors are attached to the vane 35 of FIG. 2. A series of three parallel spaced-apart inner current carrying conductors 232, 233 and 237 are deposited on the inner surface of the bottom portion of the vane 222 opposite the respective outer conductors.

A backing member 239 is attached thereto in a similar manner as the backing member 32 is secured to the folded film blank of FIG. 1. The backing member 239 is composed of similar film material, and includes a series of depending channels 240, which extend partially into the inner interiors of the vanes, in a similar manner as the depending ridge 191 of the foam backing member 190 extends into the interior space of the vane 187 of FIG. 6.

Referring now to FIG. 9, there is shown an acoustic transducer, which is constructed in accordance with the present invention, and which includes a diaphragm 241 adapted to be driven by a magnet assembly (not shown) similar to the magnet assembly 14 of FIG. 1. The diaphragm 241 is generally similar to the diaphragm 186 of FIG. 6, except that the diaphragm 241 does not include the gussets therein. The diaphragm 241 includes a series of elongated parallel, spaced-apart, U-shaped vanes, such as the vanes 243 and 244.

Considering now the vane 243, it being understood that the vane 244 being similar to it, the vane 243 includes a series of three outer current carrying conductors 245, 247 and 249 arranged about the outer periphery of the bottom portion of the vane 243. A series of three inner conductors 250, 252 and 254 are spaced about the inner surface of the vane 243, opposite corresponding ones of the outer voice coil conductors and in registration therewith.

A foam backing sheet 258 is disposed in place in a manner similar to the foam backing sheet 190. A series of elongated depending ridges, such as the ridges 261 and 263, are disposed in the upper portions of the interior of the vanes, such as the corresponding vanes 243 and 244. Thus, the ridges 261 and 263 serve the same purpose as the channels 240 of the diaphragm 225A.

While particular embodiments of the present invention have been disclosed, it is to be understood that various different modifications are possible and are contemplated within the true spirit and scope of the appendant claims. For example, many different types and kinds of materials may be employed for the diaphragm of the present invention. There is no intention, therefore, of limitations to the exact abstract or disclosure herein presented.

I claim:

1. In an electro-acoustic transducer having spaced-apart magnet means, a diaphragm comprising a folded sheet of film material having a front surface and having a plurality of spaced-apart elongated projections extending from the back side thereof and being channel-shaped throughout their lengths, each one of said projections having conductor means disposed thereon and extending substantially in alignment with said magnet means to coact electromagnetically therewith; a substantially flat, thin sheet secured in overlying relationship with said front surface; and wherein a series of pairs of inward extending gussets are formed in said leg portions and contact one another.

2. In an electro-acoustic transducer, a diaphragm according to claim 1, wherein said gussets each extend into a web portion of said folded sheet interconnecting said projections.

3. In an electro-acoustic transducer having spaced-apart magnet means, a diaphragm comprising a folded sheet of film material having a front surface and having a plurality of spaced-apart elongated projections extending from the back side thereof and being channel-shaped throughout their lengths, each one of said projections having conductor means disposed thereon and extending substantially in alignment with said magnet means to coact electromagnetically therewith; a substantially flat, thin sheet secured in overlying relationship with said front surface; wherein each one of said projections is generally U-shaped, has a bight portion interconnecting a pair of leg portions, and has at least a portion of said conductor means disposed on said bight portions; further including conductor means disposed on the inside surface of said channel-shaped surface; and wherein said thin sheet includes a series of spaced-apart depending channels for extending partially into corresponding ones of said projections.

4. An electro-acoustic transducer diaphragm for coacting with a plurality of spaced-apart magnet means, a diaphragm comprising:

a folded sheet of film material having a front surface and having a plurality of spaced-apart elongated projections extending from the back side thereof and being channel-shaped throughout their lengths, each one of said projections having conductor means disposed thereon and extending substantially in alignment with said magnet means to coact eletromagnetically therewith, each one of said projections being generally U-shaped and having a bight portion interconnecting a pair of leg portions, each one of said projections having inwardly extending rigidifying gussets being formed in its leg portions and contacting one another.

5. An electro-acoustic transducer diaphragm according to claim 4, wherein said gussets each extend into a web portion of said folded sheet interconnecting said projections.

6. An electro-acoustic transducer diaphragm according to claim 5, wherein said gussets each extend in a direction transverse to the longitudinal direction of the projections.

7. An electro-acoustic transducer diaphragm according to claim 4, wherein said front surface is formed by a sheet of foam material having depending ridges extending partially into corresponding ones of said projections.

8. An electro-acoustic transducer diaphragm according to claim 4, further including a second sheet overlying said front surface and including a series of spaced-apart depending channels for extending partially into corresponding ones of said projections.

9. An electro-acoustic transducer diaphragm for coacting with a plurality of spaced-apart magnet means, a diaphragm comprising:

a folded sheet of film material having a front surface and having a plurality of spaced-apart elongated projections extending from the back side thereof and being channel-shaped throughout their lengths, each one of said projections having conductor means disposed thereon and extending substantially in alignment with said magnet means to coact eletromagnetically therewith, each one of said projections being generally U-shaped and having a bight portion interconnecting a pair of leg portions, said front surface being a web interconnecting said projections, said web having rigidifying gussets therein extending between said projections in a direction transverse to the longitudinal direction of said projections.

10. An electro-acoustic transducer diaphragm according to claim 9, wherein each one of said projections having inwardly extending rigidifying gussets formed in its leg portions and connected together.

* * * * *